US005174481A

United States Patent [19]

LeDune

[11] Patent Number: 5,174,481

[45] Date of Patent: Dec. 29, 1992

[54] BAT STRAP

[76] Inventor: David W. LeDune, R. R. #2 Box 245, Carlisle, Ind. 47838

[21] Appl. No.: 766,059

[22] Filed: Sep. 26, 1991

[51] Int. Cl.[5] ..... A45F 3/02

[52] U.S. Cl. ..... 224/202; 224/901; 224/205; 224/250; 224/257

[58] Field of Search ..... 224/202, 205, 150, 242, 224/246, 250, 251, 257, 258, 901, 913, 914, 917; 294/149, 150, 157, 159, 160, 162, 163; 280/814; 206/315.1; D3/32, 36, 101, 104

[56] References Cited

U.S. PATENT DOCUMENTS

| | | | |
|---|---|---|---|
| 813,216 | 2/1906 | Karibo | 294/157 |
| 2,576,559 | 11/1951 | Bennek | 224/246 X |
| 2,812,123 | 11/1957 | Girton | 224/150 |
| 2,884,172 | 4/1959 | Kubo | 224/149 |
| 2,915,233 | 12/1959 | Moomaw | 224/202 X |
| 3,182,871 | 5/1965 | Gossler | 224/149 |
| 4,098,441 | 7/1978 | Campbell | 224/150 |
| 4,693,402 | 9/1987 | Comeau | 224/215 |
| 4,793,532 | 12/1988 | Cash | 224/202 |
| 4,863,083 | 9/1989 | Chen | 224/250 X |
| 4,867,359 | 9/1989 | Donovan | 224/202 |
| 4,903,875 | 2/1990 | Smart et al. | 224/258 |
| 5,092,505 | 3/1992 | Olschlager | 224/150 |

FOREIGN PATENT DOCUMENTS

| | | | |
|---|---|---|---|
| 2265424 | 11/1975 | France | 280/814 |

*Primary Examiner*—Henry J. Recla
*Assistant Examiner*—Casey Jacyna
*Attorney, Agent, or Firm*—H. John Barnett

[57] ABSTRACT

A strap or cloth web personal carrier for a bat, ball and mitts, The carrier includes a collapsible pocket made from a plurality of cloth webs or straps, or a shallow net or solid nylon bag to receive a ball and the barrel end of a bat. The collapsible pocket has a cloth web or strap around the top to reinforce the pocket. The reinforcing strap may be elastic, or may include overlapping Velcro fasteners for tightening around the bat being carried. An elongated strap or cloth web is secured to, and extends out from, the collapsible pocket, and includes a sliding loop at its outer end which is looped around the bat near the top of the bat handle to define a sling. The combination is conveniently carried over the user's shoulder like a rifle sling, with the bat extending across the wearer's back to define part of the carrier. Additional small loops are provided on the strap for carrying mitts or other accessories.

2 Claims, 1 Drawing Sheet

BAT STRAP

BACKGROUND OF THE INVENTION

1. Field of the Invention

The subject invention relates to backpacks and carrying devices, and more particularly, to carrying devices for sporting equipment, namely baseball and softball equipment. The particular device is made of flexible material which can be folded and stored in a pocket when not in use.

2. Description of the Related Art

The following patents relate to various kinds of backpacks and carrying devices:

| Patent Number | Patentee | Date |
|---|---|---|
| 4,213,549 | Hibbard | 1980 |
| 4,378,866 | Pelavin | 1983 |
| 4,463,885 | Ball, et al | 1984 |
| 4,518,107 | Amos | 1985 |
| 4,693,402 | Comeau | 1987 |
| 4,890,731 | Mroz | 1990 |
| 4,968,048 | Lortie | 1990. |

Comeau appears to be the most pertinent of the above references, but the bat is stored in a substantially full-sized pocket in the main, larger, back pack bag. The bat does not form part of the shoulder sling when Comeau's back pack is loaded with sporting equipment.

Hibbard, Pelavin and Amos were all cited against Comeau's patent application, but of these, only Amos appears to be pertinent. However, Amos' skis do not form part of the carrier. A reinforcing strap for the skis extends diagonally across the back of the carrier, which also includes two shoulder straps and two waist belts. The skis are held in place by a pair of straps which have Velcro closures.

Ball et al disclose a strap ski carrier which defines a carrying handle, but the skis do not form part of a shoulder sling. Ball et al do mention that their strap can be folded and carried in a pocket.

Mroz and Lortie are of interest because they show more complex carrying systems for baseball or softball equipment. Neither could be considered intended for carrying on the back of a user.

SUMMARY OF THE INVENTION

The subject invention is directed to a strap or cloth web personal carrier for a bat, ball and mitts. The carrier includes a collapsible pocket made from a plurality of cloth webs or straps, or a shallow net or solid nylon bag. The collapsible pocket has a cloth web or strap around the top to reinforce the pocket. The reinforcing strap may be elastic, or may include overlapping Velcro hook and loop fasteners for tightening around the barrel end of the bat being carried.

An elongated strap or cloth web is secured to, and extends out from, the collapsible pocket and includes a sliding loop at its outer end which is looped around the bat near the top of the bat handle to define a sling. The combination of the bat strap with its outer end secured to the outer end of the bat handle, and its collapsible pocket disposed around the barrel end of the bat is conveniently carried over the user's shoulder like a rifle sling, with the bat extending across the wearer's back to define part of the carrier. Additional small loops are provided on the strap for carrying mitts or other accessories.

DESCRIPTION OF THE PREFERRED EMBODIMENT

Figure 1:
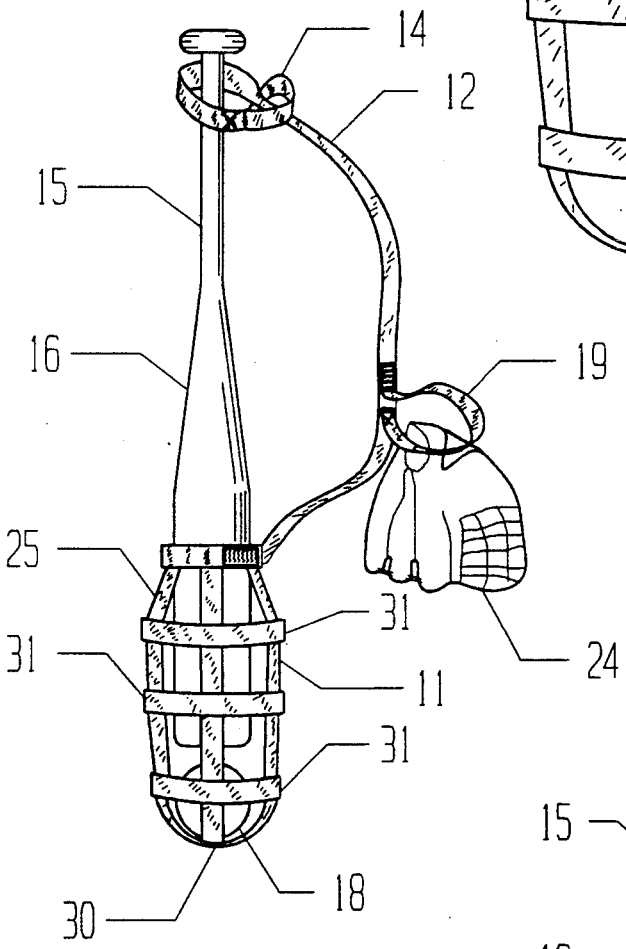
FIG. 1 of the drawings is a schematic plan view with some parts broken away showing the carrying device of the invention loaded with a ball, a bat and one mitt.
Figure 3:
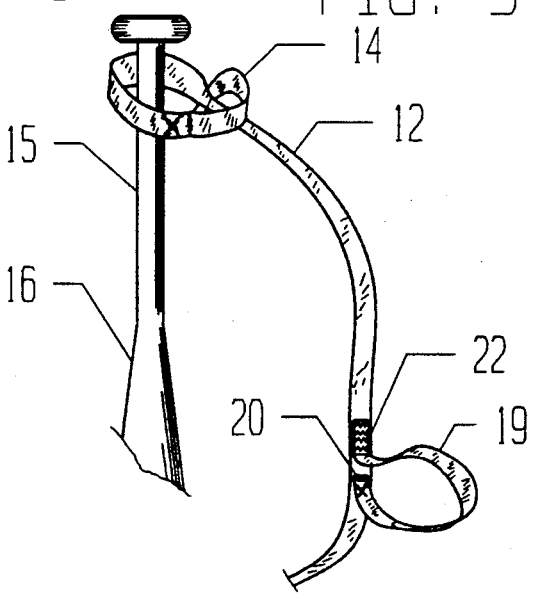
FIG. 3 is an enlarged detail with parts broken away showing the flexible sling strap and the flexible glove straps on the sling strap.

As best seen in FIG. 1, the bat strap carrying device 10 of the invention comprises a flexible pocket 11 and a sling strap 12. The sling strap 12 is connected at its lower end 13 to the flexible pocket In the present embodiment, the flexible pocket 11 and the sling strap 12 are made of nylon or cotton webbing or belting, and may be sewn together or fastened by other means, such as rivets.

The upper end of the sling strap 12 terminates in a loop 14 which is adapted to surround and hold the upper end 15 of a bat 16. The loop 14 may be permanently sewn in the sling strap 12, or it may be formed by Velcro hook and loop fasteners or hook and eye fasteners or like devices. The important requirement is that the loop be strong during transport, and easily assembled on, and removed from, the bat 16.

The lower end 17 of the bat 16 is shown in FIG. 1 resting on top of a ball 18 in the flexible pocket 11. The flexible pocket 11, the sling strap 12 and the bat 16 cooperate together to define a carrying device for sporting equipment. The bat 16 defines an essential part of the sling, which can be carried over the shoulder, or diagonally across the back.

The sling strap 12 is provided with several mitt straps 19. First ends 20 of the mitt straps 19 are sewn to the sling strap 12, and the second ends 21 are provided with Velcro hook and loop fastener means 22 which attaches to Velcro hook and loop fastener patches 23 on the sling strap 12. A mitt 24 can be carried on one or both of the mitt straps 19.

Figure 2:
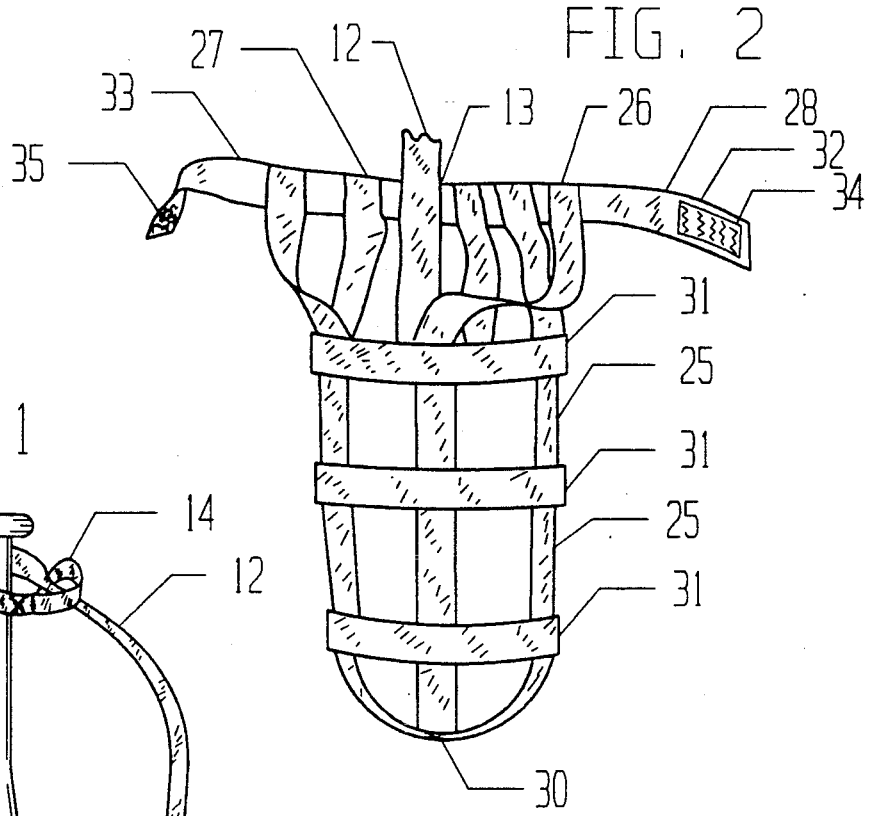
FIG. 2 is an enlarged detail with parts broken away of a part of the carrying device shown in FIG. 1 showing the flexible ball-bat pocket and its connection to the sling strap.

The flexible pocket 11 is shown with three flexible straps 25, each of which is the same length, and each of which has ends 26 and 27 which are fastened around a split ring strap 28 which defines the top end 29 of the flexible pocket 11. The flexible straps 25 are fastened together at their respective midpoints 30 as by sewing, riveting or other fastening means. To give the flexible pocket more reinforcement, additional ring straps 31 are disposed below the top ring strap 28, as shown in FIGS. 1 & 2.

The split ring strap 28 has a first end 32 and a second 33. End 32 is provided with a Velcro fastener 34 on its in surface which cooperates with a complementary Velcro hook and loop fastener pad 35 on the outer surface of the second end 33 of split ring strap 28. When the lower end 17 of a bat 16 is placed in the flexible pocket 11, the split ring strap 28 is secured tightly around the bat 16 by means of the Velcro hook and loop fastener 34 and Velcro hook and loop fastener pad 35.

I claim:

1. A carrier strap for carrying a bat and a ball comprising:

a flexible fabric pocket having a lower closed end and an upper open end adapted to receive a ball and the barrel end of a bat, including a circular flexible strap defining the open end of the flexible pocket;

a plurality of similar flexible straps defining the body of said flexible pocket, each flexible strap having a midportion, and first and second ends secured to the circular flexible strap at diametrically opposite attachments, said straps being disposed around the circular flexible strap at spaced intervals, and secured together at their intersecting mid-portions;

at least one additional circular flexible strap secured to each of the flexible straps defining the body of the flexible pocket at a spaced interval below, and parallel to, the first circular flexible strap to further reinforce the flexible pocket; and an elongated flexible strap having an inner end, an intermediate portion, and an outer end, the inner end being secured to the open end of the flexible fabric pocket, and the outer end terminating in a loop adapted to be secured around the outer end of a bat handle to define a carrying sling for a bat and a ball which is completely collapsible for convenient pocket storage when not in use as a carrier.

2. The carrier strap of claim 1, including at least one releasable mitt fastening means secured to the intermediate portion of the elongated flexible strap.

* * * * *